US005711369A

United States Patent [19]

Huddleston et al.

[11] Patent Number: 5,711,369

[45] Date of Patent: Jan. 27, 1998

[54] HEAT EXCHANGER MANIFOLD HAVING A SOLDER STRIP

[75] Inventors: Howard Murray Huddleston, Cambridge City, Ind.; Ramchandra L. Patel, Southgate, Mich.

[73] Assignee: Ford Global Technologies, Inc., Dearborn, Mich.

[21] Appl. No.: 771,357

[22] Filed: Dec. 16, 1996

[51] Int. Cl.[6] ..... B23K 1/00

[52] U.S. Cl. ..... 165/79; 165/173; 228/183; 228/255

[58] Field of Search ..... 165/76, 79, 173; 228/183, 253, 255; 29/890.052, 890.054

[56] References Cited

U.S. PATENT DOCUMENTS

| | | | |
|---|---|---|---|
| 2,064,036 | 12/1936 | Sandberg . | |
| 2,867,416 | 1/1959 | Lieberherr . | |
| 3,310,869 | 3/1967 | La Porte et al. | 29/890.03 |
| 3,557,596 | 1/1971 | Esselunn et al. . | |
| 3,604,104 | 9/1971 | Glasgow . | |
| 3,710,473 | 1/1973 | McElwain et al. . | |
| 4,002,198 | 1/1977 | Wagner et al. . | |
| 4,327,800 | 5/1982 | Miller . | |
| 4,824,184 | 4/1989 | Miller, Jr. . | |
| 4,917,180 | 4/1990 | Wolf et al. . | |
| 5,090,477 | 2/1992 | Sprow et al. . | |
| 5,172,761 | 12/1992 | Lyon . | |
| 5,190,101 | 3/1993 | Jalilevand et al. . | |
| 5,464,145 | 11/1995 | Park et al. | 228/183 |

FOREIGN PATENT DOCUMENTS

| | | | |
|---|---|---|---|
| 605841 | 9/1960 | Canada | 165/79 |
| 63-189791 | 8/1988 | Japan . | |
| 63-279094 | 11/1988 | Japan . | |
| 4-161797 | 6/1992 | Japan . | |

*Primary Examiner*—Allen J. Flanigan
*Attorney, Agent, or Firm*—Raymond L. Coppiellie

[57] ABSTRACT

A method for making a manifold for a tube and fin type heat exchanger is disclosed wherein the manifold includes a solder strip. The manifold includes a channel having a base member and a pair of vertical walls, a plurality of fluid conducting passageways in the base member, and a solder strip disposed in the channel. The strip is secured in place by bending a portion of the wall over a longitudinal edge of the solder strip.

11 Claims, 2 Drawing Sheets

HEAT EXCHANGER MANIFOLD HAVING A SOLDER STRIP

BACKGROUND OF THE INVENTION

1. Field of the Invention

The present invention relates generally to manifolds for heat exchangers such as condensers, evaporators and oil coolers used in automotive vehicles. More particularly, the present invention relates to a manifold having a solder strip thereon and a method for making a manifold having such a solder strip.

2. Disclosure Information

Fin and tube type heat exchangers are commonly used in vehicle, industrial and residential environments for heating and cooling purposes. Typically, these heat exchangers utilize a plurality of tubes through which the fluid to be heated or cooled passes. The number of tubes utilized depends on the thermal capacity requirements of the fin and tube heat exchanger. In order to connect these tubes together so that the fluid can flow through the tubes, manifolds are used having a series of openings corresponding to and mating with the ends of the tubes. The manifolds have an inlet port and an outlet port which circulate the fluid through the heat exchanger and then returns the fluid to a remote location for subsequent recycling.

It is known in the art to fabricate manifolds having holes or flanges for receiving the tubes. It also is known to form tube-like projections on the manifolds which project into the heat exchanger tubes. It is necessary to bond the heat exchanger tubes to these manifolds to achieve a leak free connection.

One known method of bonding tubes to a manifold involves placing a number of solder rings on the ends of the tubes themselves or over the projections of the manifold. The solder rings melt in a brazing oven to form a sealed connection between the tubes and the manifold. However, placing the individual solder rings over each end of the tube or projection is very labor intensive and often results in missing or extra rings on the ends of the tubes/projections.

A second manner in which solder rings are used is in the form of a solder strip. The solder strip comprises a plurality of the rings stamped out of a planar sheet of solder material. This strip is placed over the projections on the manifold before attaching the heat exchanger tubes to the manifold. While being an improvement to individually placed rings, the strip typically is used with manifolds having the tube-like projections. Many manifolds used today rely upon apertures into which fluid tubes pass in place of tube-like projections. This type of strip could be used with these types of manifolds, but alignment of the solder rings directly over the apertures is difficult to maintain. Therefore, it would be advantageous to provide a solder strip which can be held in place over a plurality of tube receiving apertures in a heat exchanger manifold.

SUMMARY OF THE INVENTION

The present invention overcomes the difficulties and deficiencies associated with prior art devices by providing a method of making a manifold for a heat exchanger, the method comprising the steps of providing a generally elongate, plastically deformable block of material and forming a first longitudinal channel member in the block on one longitudinal side thereof, the first longitudinal channel member having a generally planar base member and a pair of vertically depending walls projecting generally perpendicularly to the plane of the base member. The method further includes the steps of forming a second longitudinal channel member in the block on a side opposite the first channel member, the second longitudinal channel member having a generally planar base member and a pair of vertically depending walls projecting generally perpendicularly to the plane of the base member, the walls defining a stepped portion extending along the longitudinal length thereof and forming a plurality of fluid conducting passageways in the base member. The fluid conducting passageways act as tube receiving apertures because the heat exchanger tubes are placed into these apertures to allow fluid communication between the manifold and the tubes. The method also comprises the steps of forming a hollow longitudinal conduit in the first channel member, providing a solder strip in the second channel member, the solder strip having a plurality of apertures corresponding to each of the plurality of fluid conducting passageways, and bending the stepped portion of the second channel member over the solder strip to hold the solder strip in a given position.

In this manner, a generally planar solder strip is securely held in place over a plurality of tube receiving apertures and misalignment of the strip is significantly reduced.

These and other objects, features and advantages of the present invention will become apparent from the brief description of the drawings, detailed description, and claims which follow:

DETAILED DESCRIPTION OF THE PREFERRED EMBODIMENTS

Figure 1:
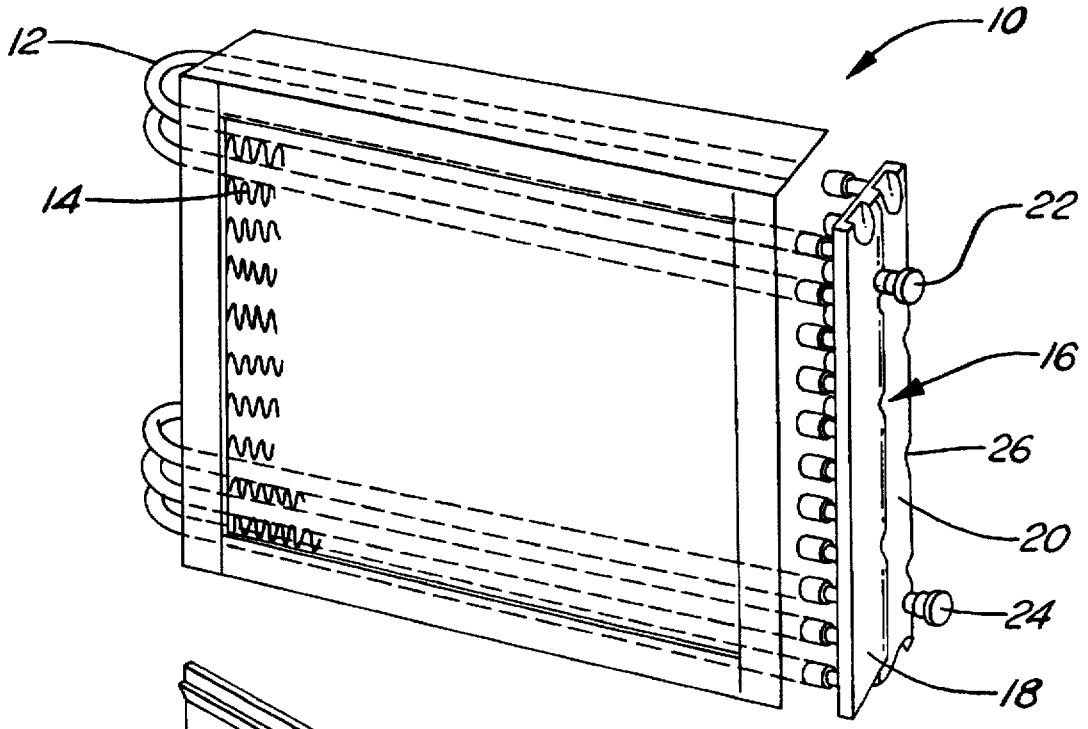
FIG. 1 is a perspective view of a tube and fin heat exchanger including a manifold structured in accord with the principles of the present invention.

Referring now to the drawings, FIG. 1 shows a tube and fin type heat exchanger 10 including a plurality of U-shaped tubes 12 with heat dissipative fins 14 interposed between each of the tubes 12. The free ends of the U-shaped tubes 12 matingly engage a manifold 16 disposed at one end of the heat exchanger 10. As shown in FIG. 1, manifold 16 is a double chambered manifold having a first fluid conduit 18 and a second fluid conduit 20. First fluid conduit 18 includes an inlet port 22 for receiving fluid therein and fluid conduit 20 includes an outlet port 24 for discharge of fluid therefrom. The manifold 16 further includes a plurality of integrally formed, crimped baffles 26 for directing fluid through the heat exchanger according to a predefined pathway. In accordance with principles well known in the heat exchanger art, fluid to be cooled (or heated) enters manifolds 16 through inlet port 22 and is directed through the plurality of U-shaped tubes 12 wherein the fluid is cooled by a secondary fluid, such as air, passing over the fins 14. The baffles 26 and the manifold 16 direct the fluid through the U-shaped tubes wherein the fluid eventually discharges from outlet port 24. It should be apparent to those skilled in the art that the heat exchanger of FIG. 1 utilizes a manifold having a pair of longitudinal fluid conduits 18, 20 although the present invention may be utilized in conjunction with a manifold having a single fluid conduit and with other types of heat exchangers, such as those known as parallel flow heat exchangers. As shown in FIG. 1, the heat exchanger is a condenser, although the principles of the present invention can be applied to other types of heat exchangers as well.

Figure 2:
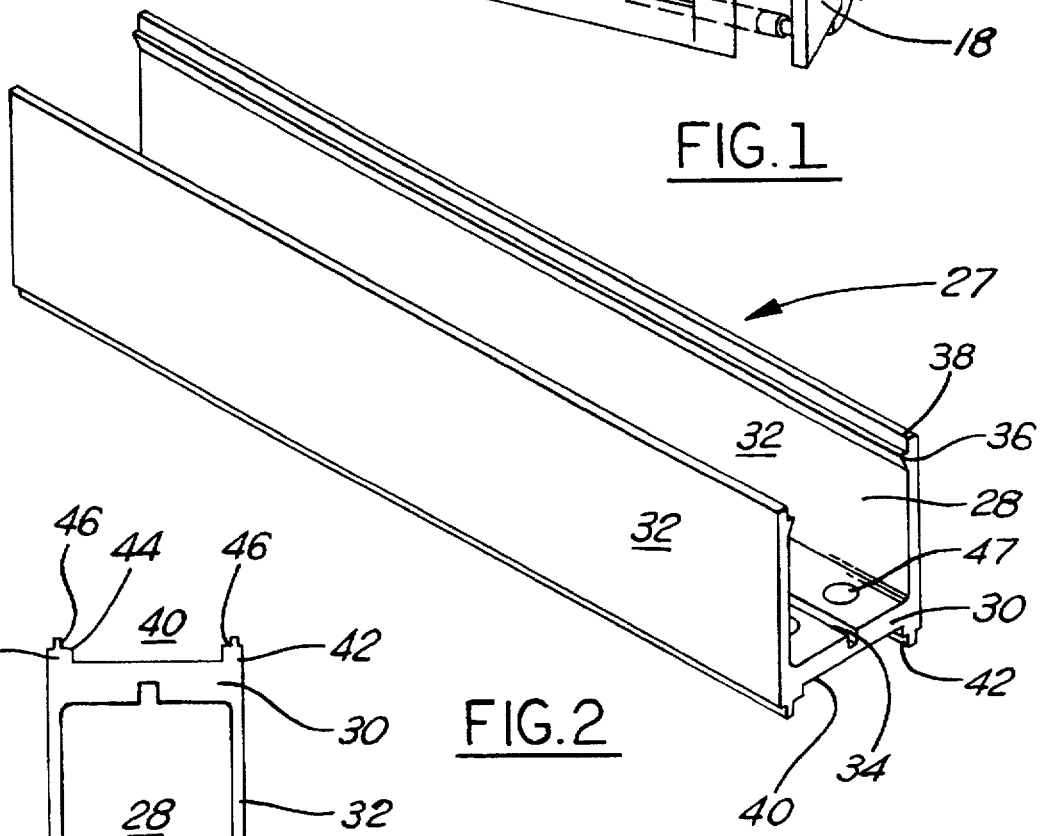
FIG. 2 is a perspective view of an extruded channel member for use with the process of fabricating a manifold according to the method of the present invention.
Figure 3:
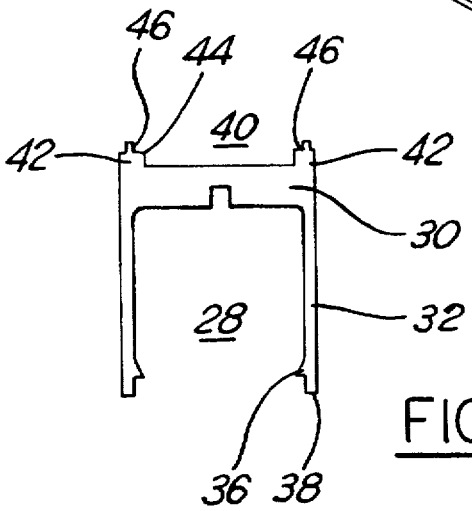
FIG. 3 is a cross-sectional view of the channel member of FIG. 2 taken along line 3—3.

The manifold 16 is fabricated from an extruded aluminum alloy such as SAE 3003, 3102, or 6062 or any of another of known types of deformable materials. Manifold 16 is formed according to the method of the present invention by first extruding an aluminum block into a member 27 such as is shown in FIGS. 2 and 3. The member 27 is extruded and includes a first longitudinal channel member 28 on one side of the member 27. The first longitudinal channel member 28 includes a generally planar base 30 with a pair of vertical walls 32 depending generally perpendicularly to the plane of the base. The base 30 includes a U-shaped slot 34 running the longitudinal length of the channel member 28 approximate medially to the longitudinal axis of the channel member 28. Each of the vertical walls 32 includes an inwardly extending flange 36 disposed near the free ends 38 of the walls. As can be seen in FIG. 3, the inwardly extending flanges 36 are angled away from the plane of the base member 30 of channel 28 for reasons which will become apparent below.

After the first channel member 28 has been extruded, the next step in the method of the present invention is to extrude a second channel member 40 on the opposite side of the first channel member 28. In practice, the first and second channel members 28, 40, respectively, can be extruded simultaneously. The second channel member extends the entire longitudinal length of member 27 and includes the same generally planar base member 30 and a pair of vertical walls 42 extending therefrom. The walls 42 extend in an opposite direction to walls 32 as can be easily seen in FIGS. 2 and 3. The walls 42 each include a shoulder 44 extending the entire longitudinal length of the member 27. These shoulders 44 define a stepped portion 46 in each of the walls 42 extending above the base member 30 by a predetermined distance.

Figure 5:
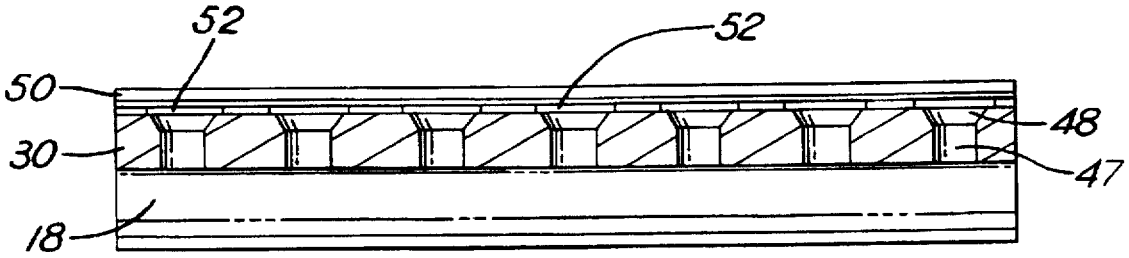
FIG. 5 is a perspective view of a manifold having a solder in accord with the principles of the present invention.

After the walls 32 and 42 are fabricated, a plurality of fluid conducting passages in the base member 30 of channel member 27 are formed. These passageways can be apertures as seen in FIG. 2 and 5 or another type of passageways such as a tube-like projection. Apertures 47 are formed by a piercing operation in base member 30. The apertures 47 have a predetermined configuration as can be seen in FIG. 5 wherein one end 48 of apertures 47 is flared. The apertures 47 communicate with the fluid conduits 18, 20 of the manifold 16. The flared ends 48 of apertures 47 receive the free ends of the U-shaped tubes 12 of the heat exchanger therein and must be secured thereto in a leak-free manner. The use of a brazing solder typically accomplishes this task as will be explained.

Figure 6:
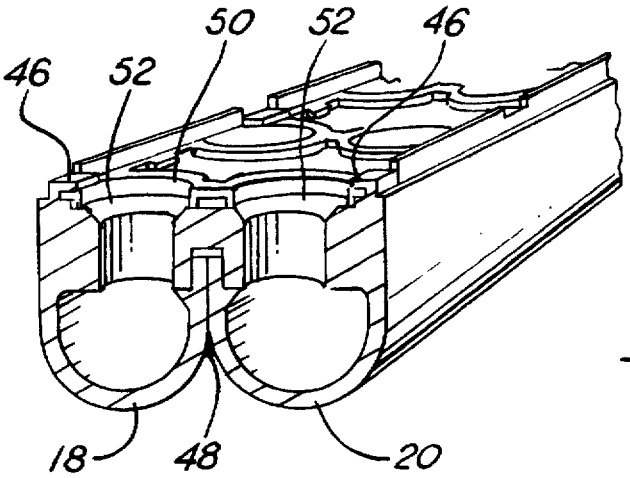
FIG. 6 is a cross-sectional view of FIG. 5 taken along line 6—6.

After the apertures 47 have been pierced into base member 30, the next step of the method of the present invention is to form the longitudinal fluid conduits 18, 20. In the present application this is accomplished by rolling the vertical walls 32 toward the longitudinal center of the base member 30 until the free ends 38 of the walls 32 engage the U-shaped slot 34 of the base member 30 as shown in FIG. 6. The walls 32 are rolled until the inwardly extending flanges 36 contact the base member 30. The angle of the inwardly extending flanges provide a positive stop when they have engaged the slot 34.

After the vertical walls have been rolled, the baffles 26 are then mechanically crimped into each of the fluid conduits 18, 20 according to a predefined location to achieve the desired circulation of fluid as is well known.

After the baffles have been formed and the ends of the manifold have been crimped, the manifold assembly is washed in a degreasing solution. From there, the inlet port 22 and outlet port 24 are formed and assembled to the manifold according to known manufacturing processes. The manifold is coated with a brazing material which typically includes a fluxing agent. The brazing material can be in the form of a paste or a wire which is placed along the longitudinal length of the manifold. The manifold assembly is then placed in a brazing oven to form a weld seam or brazed joint along the longitudinal length of the manifold as shown at 48 in FIG. 6 between each of the fluid conduits 18 and 20. The transverse ends of the fluid conduits are also sealed at this point in the process.

Figure 4:
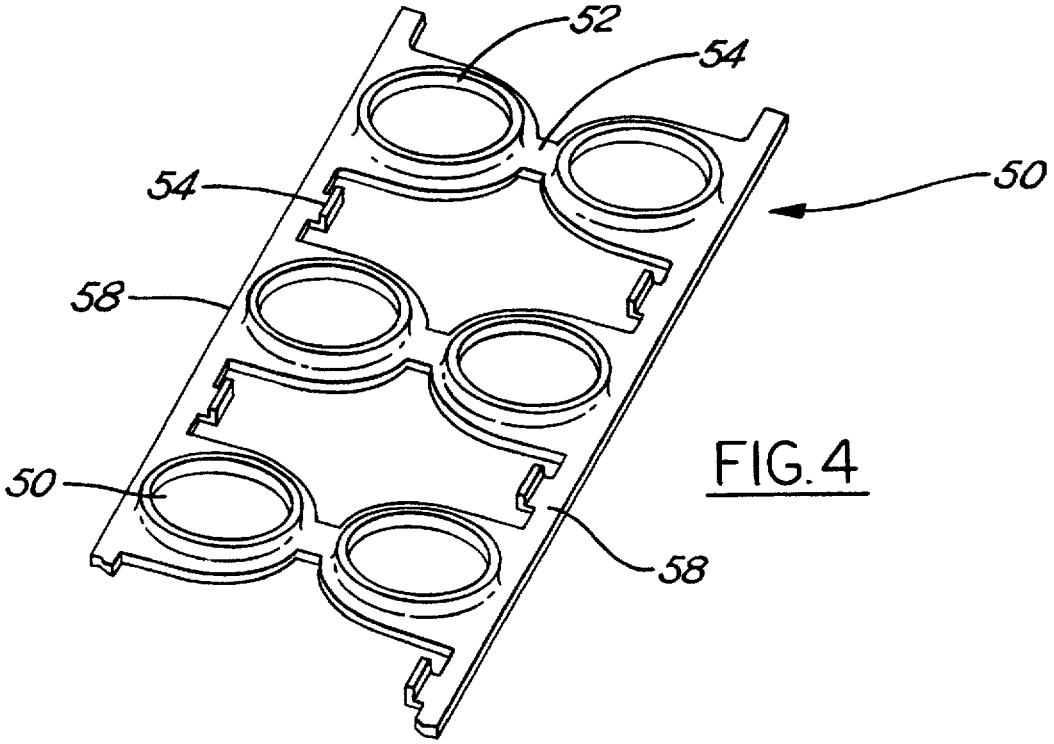
FIG. 4 is a perspective view of a solder strip used with a manifold in accord with the principles of the present invention.

A solder strip 50 (FIG. 4) comprising a plurality of solder rings 52 interlinked together by a plurality of bridges 54 is next placed onto the stepped portion 46 of the second longitudinal channel member 40 of the formed manifold assembly. The solder strip 50 is placed such that solder rings 52 are placed directly over the apertures 47. To secure the strip 50 in the proper location so that it does not shift during the remaining manufacturing operations, a portion of each of the stepped portions 46 are bent over the solder strip as shown in FIG. 6. This can be accomplished by simply applying a pressure to the external side of the stepped portion 46 until it deforms plastically of a longitudinal edge 58 of the solder strip. In the preferred embodiment, each stepped portion 46 of each vertical 42 is bent over some portion of the solder strip to secure the strip into proper position.

After the manifold has been assembled according to the above process, the U-shaped tubes are connected to the manifold 16. The free ends of the U-shaped tube of the heat exchanger extend through the solder rings 52 of the solder strip 50 to matingly engage apertures 47 of the manifold. Flux (liquid or paste) is then applied over the solder strip. The assembly is then placed in an oven to cause the solder rings to melt around the tube ends to form solder joints at the flared end of each aperture 47 to ensure a leak-free, secure joining of the manifold to the U-shaped tube ends. The manifold may be joined to the heat exchanger in any of a number of known processes such as by vacuum brazing or in a controlled atmosphere brazing oven.

Alternatively, and as described in U.S. Pat. No. 5,190,101, assigned to the assignee of the present invention, the disclosure of which, beginning at column 4, line 58, et. seq. is hereby incorporated by reference, a second embodiment of the present invention may include a different configuration of the plurality of fluid conducting passageways in the base member formed during the extrusion of the U-shaped channel member. The fluid conducting passageways can be extruded as tubular members projecting perpendicularly to the plane of the base member. The diameter of the tubular member must be less than the diameter of the free ends of the U-shaped tubes of the heat exchanger so that a nonleaking seal (by brazing or soldering) can be formed between the manifold and the U-shaped tubes. Each of the tubular members communicates with an interior volume of the fluid conducting members. This allows fluid to pass from the fluid conduits through the fluid conducting passageway and into the U-shaped tubes. The solder strip 50 is placed over the projecting ends of the tubular members and can be secured in that position by bending the stepped portions 46 of the second channel member 40 over the strip as explained above.

In view of the above, variations and modifications to the present invention will no doubt occur to those skilled in the art. For example, the method of manufacturing the manifold from a single extruded piece of aluminum can also be performed for a single manifold as well as a double manifold. Various other materials may also be chosen to fabricate the manifolds and the present invention is not meant to be limited solely to those specified above. It is the following claims, including all equivalents which define the scope of our invention.

What is claimed is:

1. A method of making a manifold for a heat exchanger, comprising the steps of:

providing a generally elongate, plastically deformable block of material;

forming a longitudinal channel member on one side of said block, the longitudinal channel member having a geverally planar base member and a pair of vertically depending walls projecting generally perpendicularly to the plane of said base member and defining a stepped portion extending along the longitudinal length thereof;

forming a plurality of fluid conducting passageways in said base member;

forming a hollow longitudinal conduit in said block on a side opposite the channel member;

providing a generally planar solder strip in said channel member, the solder strip having a plurality of apertures corresponding to each of said plurality of fluid conducting passageways; and bending the stepped portion of said channel member over the solder strip to hold the solder strip in a given position.

2. A method according to claim 1, wherein the step of forming the longitudinal channel is performed by an extrusion process.

3. A method according to claim 1, wherein the step of providing the solder strip in the channel member includes the step of placing the solder strip on the stepped portion of the channel.

4. A method according to claim 1, wherein the step of bending the stepped portion of the channel member further includes the step of bending only selected areas of the stepped portion over selected areas of the solder strip.

5. A method according to claim 1, wherein the step of providing a solder strip includes providing a solder strip having a plurality of collar members interlinked together with a plurality of bridge members.

6. A method of making a manifold for a heat exchanger, comprising the steps of:

providing a generally elongate, plastically deformable block of material;

forming a first longitudinal channel member in said block on one longitudinal side thereof, the first longitudinal channel member having a generally planar base member and a pair of vertically depending walls projecting generally perpendicularly to the plane of said base member;

forming a second longitudinal channel member in said block on a side opposite said first channel member, the second longitudinal channel member having a generally planar base member and a pair of vertically depending walls projecting generally perpendicularly to the plane of said base member, said walls defining a stepped portion extending along the longitudinal length thereof;

forming a plurality of fluid conducting passageways in said base member;

forming a hollow longitudinal conduit in said first channel member;

providing a solder strip in said second channel member, the solder strip having a plurality of apertures corresponding to each of said plurality of fluid conducting passageways; and bending said stepped portion of said second channel member over said solder strip to hold the solder strip in a given position.

7. A method according to claim 6, wherein the step of forming a hollow longitudinal conduit in the first channel member includes the step of rolling said vertical walls of said first channel member toward the longitudinal center of said base member until the free ends of said vertical walls contact said base member so as to form a pair of hollow longitudinal fluid conduits.

8. A method according to claim 6, wherein the step of forming the first and second longitudinal channel members is performed by an extrusion process.

9. A method according to claim 8, wherein the step of providing the solder strip in the second channel member includes the step of placing the solder strip on the stepped portion of the second channel member.

10. A method according to claim 9, wherein the step of bending the stepped portion of the second channel member further includes the step of bending only selected areas of the stepped portion over selected areas of the solder strip.

11. A manifold for an automotive heat exchanger assembly, comprising:

a longitudinal fluid conduit having a generally planar base member and a generally arcuate top member, said base member including a channel portion having a pair of vertically depending walls extending the longitudinal length of the manifold, each of the walls having a step therein along the longitudinal length of the walls;

a plurality of fluid conducting apertures defined in said base member, said apertures being in fluid communication with said fluid conduit;

an elongate solder strip disposed over said plurality of fluid conducting apertures, said solder strip being disposed on said step of said vertical walls, said solder strip including a plurality of collars interlinked by a plurality of bridges; and wherein said strip is securely held in a predetermined position such that said collars are disposed directly over said fluid conducting apertures by bending selected portions of said step over said solder strip.

* * * * *